United States Patent [19]

Higgins et al.

[11] 4,256,124

[45] Mar. 17, 1981

[54] METHOD AND APPARATUS FOR MANUFACTURING FILTER CIGAR

[75] Inventors: D. Bernard Higgins, Berwick, Pa.; Frederick D. Godfrey, Jr., Maplewood, N.J.

[73] Assignee: Gulf & Western Corporation, New York, N.Y.

[21] Appl. No.: 9,611

[22] Filed: Feb. 5, 1979

[51] Int. Cl.[3] ..... A24C 1/32; A24C 5/47

[52] U.S. Cl. ..... 131/29; 131/61 R; 131/76; 131/88; 131/94

[58] Field of Search ..... 131/88, 4 A, 4 R, 8 R, 131/9, 10 R, 11 R, 15 R, 20 R, 29 R, 58, 59, 61 R, 92, 105, 36, 88, 94

[56] References Cited

U.S. PATENT DOCUMENTS

| | | | |
|---|---|---|---|
| 2,167,170 | 7/1939 | Burns | 131/76 X |
| 3,189,032 | 6/1965 | Brothers | 131/11 |
| 3,242,926 | 3/1966 | Clausen | 131/29 X |
| 3,276,454 | 10/1966 | Schon | 131/29 |
| 3,653,390 | 4/1972 | Louden | 131/11 |
| 3,794,048 | 2/1974 | Molins et al. | 131/11 X |

FOREIGN PATENT DOCUMENTS

| | | | |
|---|---|---|---|
| 1436073 | 5/1976 | United Kingdom | 131/4 A |

*Primary Examiner*—Stephen C. Pellegrino

*Attorney, Agent, or Firm*—Gregory J. Battersby

[57] ABSTRACT

Method and apparatus are provided for manufacturing a filtered large cigar which includes the steps of simultaneously introducing onto the rolling table of a cigar rolling machine preformed cigar filters and a charge of tobacco filler material for spiral wrapping within a sheet of cigar binder material which has simultaneously been introduced onto the rolling table. A reinforcement strip including layers of reinforcing tape and a nonflammable foil is also introduced onto the rolling table. In this manner, during the subsequent rolling operation, the reinforcement strip becomes circumferentially wrapped about and bonded to the binder over the interface between the filter and filter material. Depending on the relative placement on the table of the reinforcement strip and binder, the reinforcement strip will be positioned either over or under the binder. Upon completion of the rolling operation, first transport means are provided for transporting the rolled bunch to locator means for tightly locating the filter against the filler charge where second transport means pick up and transport the located bunch to crimping means where the bunch is crimped. Third transport means then pick up and transport the crimped and located bunch to conventional wrapping means where it is wrapped in either a natural leaf or a manufactured cigar wrapper.

27 Claims, 24 Drawing Figures

52
210A
211A
216
210B
214
211B
220
240
262
263
264
270
4
251
250B
222
260
211E
210E
212
54
210D
211D
50
253
250A
261
250
4
252
256
5
252
255
254
258
257
254
402
401B
405
250
130
401A
135
132

50
52
54
210A
210B
210C
210D
210E
212
214
220
221
222
223
224
240
250
252
253

181
182
40
30
180
130
20
52
50
54
22
100
132

METHOD AND APPARATUS FOR MANUFACTURING FILTER CIGAR

RELATED APPLICATION

Cross reference is made to concurrently filed United States Patent Application Ser. No. 009,612, filed on Feb. 5, 1979, in the names of William F. Cartwright, Alan Cornell, D. Bernard Higgins and Robert P. Mikkelson for "Filter Cigar", the disclosure of which is expressly incorporated herein by reference thereto.

BACKGROUND OF THE INVENTION

This invention relates generally to a method and apparatus for manufacturing a filtered large cigar having a bunch including a preformed cigar filter and a conventional tobacco filler charge which are spirally wrapped by a conventional tobacco binder and, more particularly, to method and apparatus for manufacturing such a filter cigar wherein the filter and tobacco filler charge are simultaneously introduced onto the rolling table of a cigar rolling machine for rolling within a spirally wrapped sheet of conventional cigar binder material to form a cigar bunch which, upon crimping and wrapping, will become a filtered large cigar. Means are also provided for simultaneously introducing onto the rolling table, prior to the rolling operation, a reinforcement strip including layers of reinforcing tape and a nonflammable foil such that, upon rolling of the bunch, the reinforcement strip will be circumferentially wrapped over and bonded to the binder at the interface between the filler and the preformed filter to prevent their separation during use and to extinguish the flame of the cigar prior to ignition of the filter.

In an alternative embodiment, the reinforcement strip is so placed on the rolling table relative to the binder that, upon completion of the rolling operation, the reinforcement strip is positioned under and bonded to the binder at the interface between the filter and filler charge. Additionally, the present method and apparatus provides means for locating the filter relative to the filler charge and heated crimper means for forming the filter into the desired head shape of an otherwise conventional "large" cigar.

Cigarettes and some small cigars, i.e. cigars less than about 110 mm in length and 8 mm in diameter, containing filters have been marketed for many years. An example of such a filtered small cigar is the one marketed by Henri Winterman of Holland under the trademark "Cafe' Filtre". Additionally, some small and medium size cigars have included filters which were incorporated into thick plastic mouthpieces or tips. "Large" cigars, i.e. cigars having a diameter of at least about 12 mm and a length of at least about 117 mm, however, due to their substantially greater diameter and length, are incapable of being used with such filter tips. Previous attempts to incorporate a filtering material within the bunch of such "large" cigars, have proven unsuccessful. The physical bulk of large cigars do not readily lend themselves to their use with a filter and prior art attempts have often resulted in cigars wherein the filter tended to separate from the tobacco filler during use. Generally, however, not a great deal of emphasis had been placed on the production of a filtered large cigar because many smokers of large cigars did not inhale the smoke and thus it was felt that a filter was somewhat wasted. In view of recent government studies on the effects of smoking and the general public acceptance of filtered cigarettes and small cigars, renewed efforts to produce a filtered large cigar have lead to the present invention.

Examples of filtered large cigars include the cigars described in U.S. Pat. Nos. 2,250,381 which issued to M. S. Kayner on July 22, 1941; 1,477,993 which issued to C. F. Bremer on Dec. 18, 1923; 972,428 which issued to F. Acker on Oct. 11, 1910 and 899,355 which issued to J. O. Therien on Sept. 22, 1908. Further, cigars incorporating spirally wound filters in their bunches are taught in U.S. Pat. Nos. 642,000 which issued to F. C. Reed on Jan. 23, 1900 and 3,165,106 which issued to C. E. Schon on Jan. 12, 1965.

Heretofore, there had been little concern for extinguishing the flame of a cigar prior to its reaching and igniting the filter. With small cigars and cigarettes the flame is not substantial and presents little problem. The problem of the flame igniting the filter with a large cigar becomes of greater concern, however, due to the large mass involved and the type of filters used. The use of a metallic band circumferentially wrapped about the external surface of a cigarette for purposes of rendering a cigarette magnetic was, however, taught in U.S. Pat. No. 2,192,569 which issued to H. S. Williams on Mar. 5, 1940.

Commercially available cigarmaking machines have failed to provide either means for incorporating preformed filters within a cigar bunch or means for reinforcing the filter and the filler charge to prevent their separation during use. U.S. Pat. No. 3,487,839, which issued to N. R. Parlatore on Jan. 6, 1970, discloses a cigar machine which includes means to wrap a tobacco band under the wrapper and over the point of intersection of a plastic filter and the tobacco filler bunch, and Schon U.S. Pat. No. 3,165,106 discloses a cigar machine for manufacturing a cigar having a spirally wound filter which is rolled with the tobacco filler charge.

The shaping and crimping of cigars is taught, for example, in U.S. Pat. No. 3,428,051 which issued to C. T. Merenda et al. on Feb. 18, 1969, and the piercing of the external end of a cigar is taught in U.S. Pat. No. 2,277,690 which issued to S. Clausen on Mar. 31, 1942. Neither, however, teach location or heated crimper means.

Against the foregoing background, it is a primary objective of the present invention to provide a method and apparatus for manufacturing a commercially acceptable filtered large cigar wherein a preformed cigar filter and tobacco filler charge are simultaneously introduced onto a cigar rolling table, mated together, and rolled within a sheet of cigar binder material with a reinforcement strip bonded to the binder and circumferentially wrapped over the interface between the filter and the filler charge.

It is another object of the present invention to provide a method and apparatus for manufacturing a filtered large cigar which includes means for maintaining a tight mating between the filter and tobacco filler charge during the rolling operation.

It is still another object of the present invention to provide a method and apparatus for manufacturing a filtered large cigar which includes means for circumferentially wrapping and bonding to the binder a reinforcement strip including layers of reinforcing tape and foil over the interface between the tobacco filler charge and the preformed filter.

It is still another object of the present invention to provide a method and apparatus for manufacturing a filtered large cigar which includes means for aligning and locating the preformed filter relative to the tobacco filler charge after rolling and prior to crimping.

It is yet still a further object of the present invention to provide a method and apparatus for manufacturing a commercially acceptable filtered large cigar having the same outward appearance as non-filtered large cigars.

SUMMARY OF THE INVENTION

To the accomplishments of the foregoing objects and advantages, the present invention, in brief summary, comprises a method and apparatus for manufacturing a filtered large cigar. A preformed filter and tobacco filler charge are simultaneously introduced onto a cigar rolling table with a reinforcement strip including layers of a reinforcing tape and nonflammable foil and a sheet of cigar binder material. The reinforcement strip and binder material are so positioned on the table that, during the subsequent rolling operation, the binder becomes spirally wound about the filter and tobacco filler charge with the reinforcement strip circumferentially wrapped about and bonded to the binder over the interface between the filter and filler charge. In an alternative embodiment, the binder and reinforcement strip are positioned on the rolling table such that, during the subsequent rolling operation, the reinforcement strip is circumferentially wrapped under but bonded to the spirally wound binder and over the interface between the filter and filler charge.

Tamping means are also provided for maintaining the filter tightly against the filler charge during the rolling operation. First transport means are provided for transporting the rolled and reinforced cigar bunch to locator means where the filter and filler are joined tightly. Second transport means are further provided for picking up the bunch at the locator means after location and transporting it to heated crimper means where the ends of the cigar are trimmed and crimped to give the appearance of a conventional cigar. Third transport means are provided for picking up the crimped bunch and transporting it to a subsequent wrapping station.

BRIEF DESCRIPTION OF THE DRAWINGS

The foregoing and still other objects and advantages of the present invention will be more apparent from the following detailed explanation of the preferred embodiments of the invention in connection with the accompanying drawings, wherein.

DESCRIPTION OF THE PREFERRED EMBODIMENT

Figure 1:
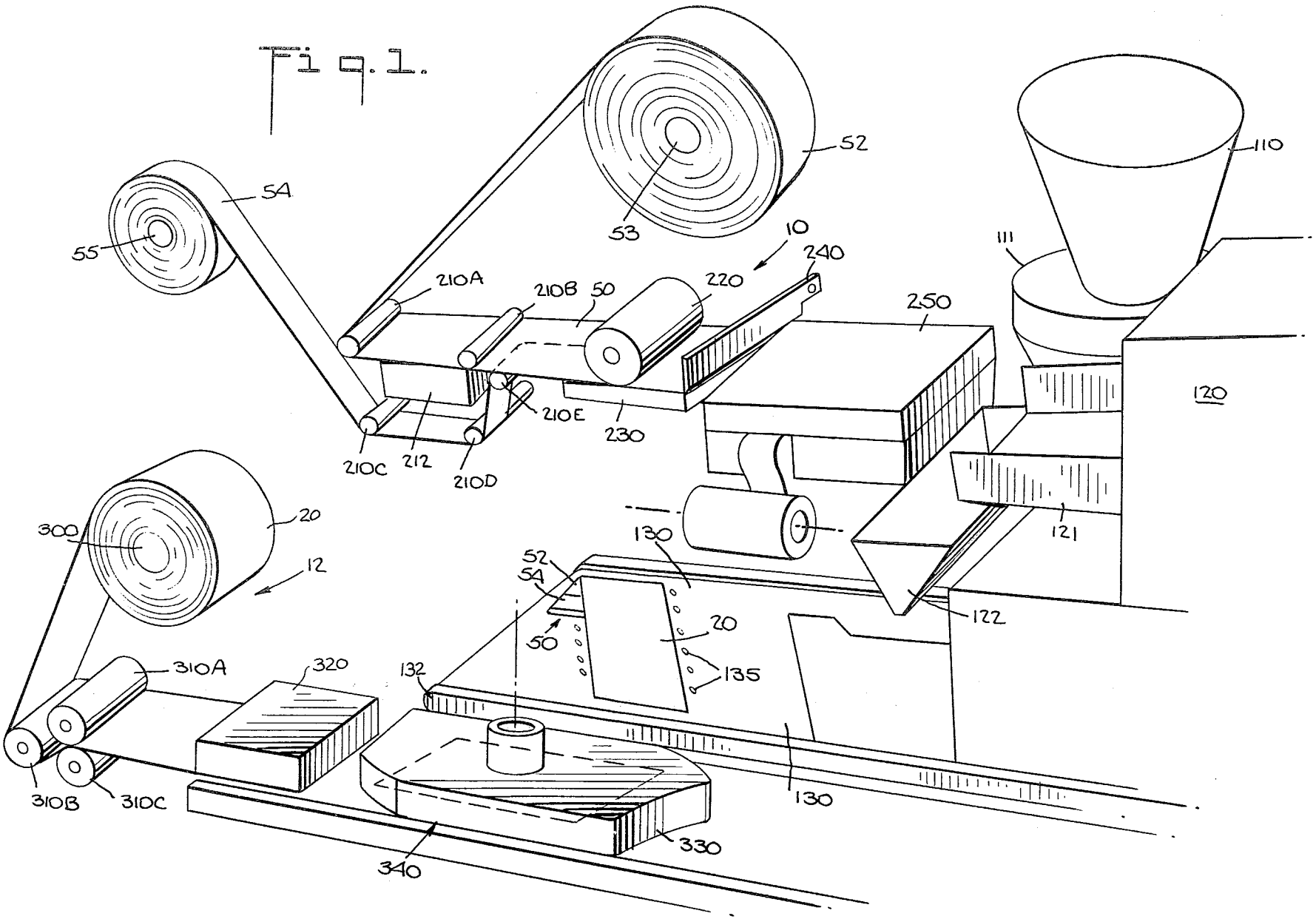
FIG. 1 is a perspective view schematically illustrating the essential elements of the present invention.

A portion of the cigar making apparatus of the present invention is shown schematically in FIG. 1 wherein a cone-shaped filter feeder 110 and a tobacco filler hopper 120 positioned adjacent to one another, are provided through which preformed cylindrically shaped cigar filters 40 and tobacco filler material 30 are simultaneously introduced for deposit on the rolling apron 130 of a conventional cigar rolling table 132 to form a cigar bunch.

Reinforcement strip forming means 10 are provided for joining together, in juxtaposition, layers of a nonflammable material, preferably a metallic foil 54 and a reinforcing tape 52 to form a reinforcement strip 50, cutting the reinforcement strip 50 into pre-determined lengths and transferring the lengths onto the rolling apron 130. Similarly, binder strip forming means 12 are further provided for cutting pre-determined lengths of cigar binder material 20 and transferring such lengths onto the rolling apron 130. Upon deposition of all elements of the cigar bunch, i.e., preformed filter 40, tobacco filler charge 30, binder material 20 and reinforcement strip 50, the cigar rolling operation shown in FIGS. 12–14 commences to spirally wrap the binder 20 about the filter 40 and tobacco filler charge 30 with the reinforcement strip 50 being circumferentially wrapped about the filter 40 and filler charge 30 over their interface. Depending upon the order of introduction onto rolling apron 130 of the cut lengths of reinforcement strip 50 and binder 20, the reinforcement strip 50 may be circumferentially wrapped over the interface between the filter 40 and filler charge 30 either over or under the binder 20. For example, as shown in FIG. 1, when the reinforcement strip 50 is first deposited on the rolling apron 130 and the binder 20 is placed over it, the reinforcement strip 50 will be circumferentially wrapped over the binder 20 in the rolled cigar bunch.

Figure 2:
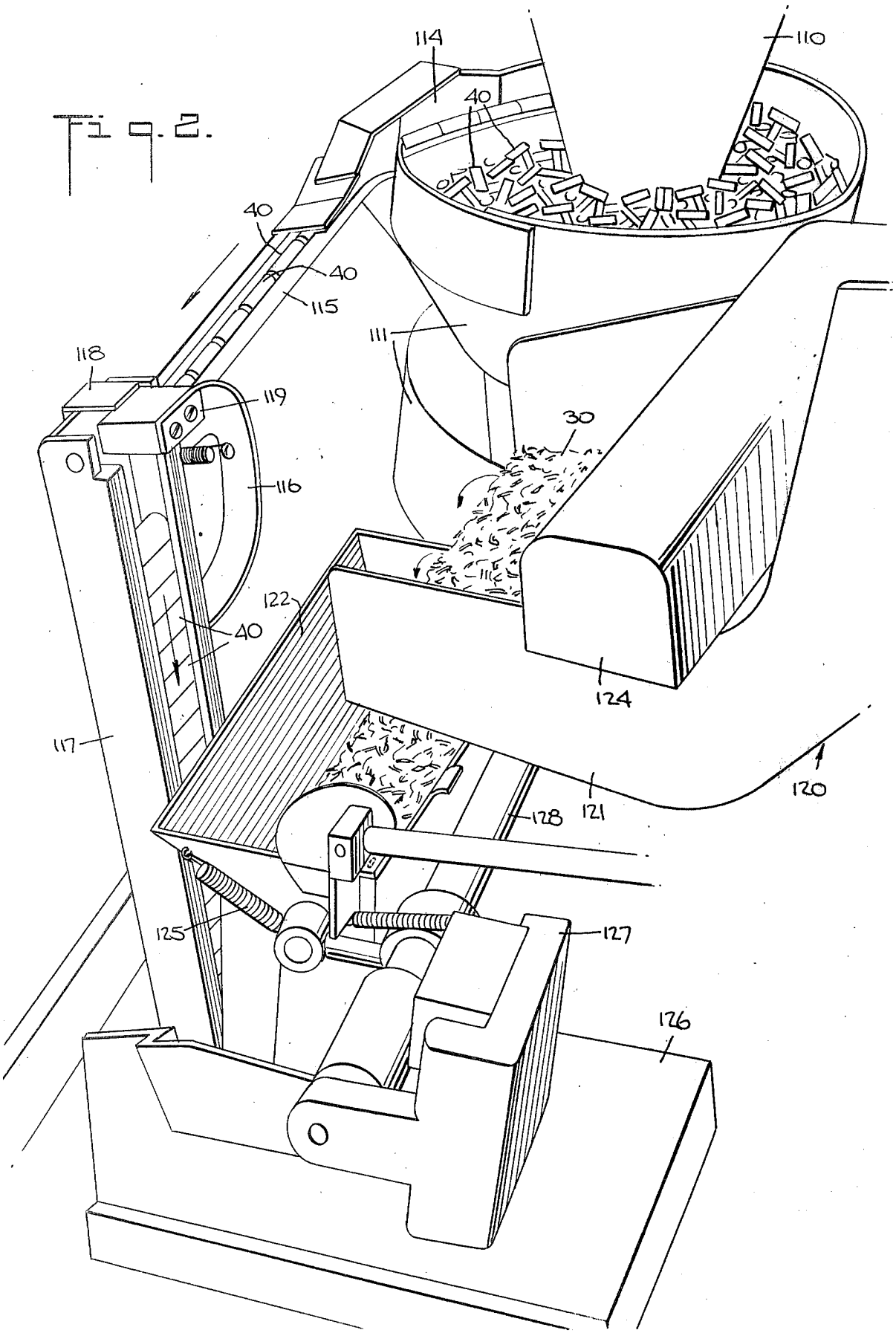
FIG. 2 is an enlarged perspective view illustrating the manner in which the preformed filters and tobacco filler charge are introduced into the cigar rolling machine.

FIG. 2 illustrates in greater detail the manner in which preformed cigar filters 40 and the tobacco filler material 30 are introduced onto the cigar rolling machine. Preformed filters 40, shown in FIG. 11, are preferably cellulose acetate filters and are fed into a conventional vibratory hopper 111 through cone-shaped filter feeder 110. Vibratory hopper 111 includes adjusting means (not shown) to vary the amount of vibration in order to control the rate of feed of the filters 40. Upon activation of vibratory hopper 111, the filters 40 are forced by vibration out of the hopper 111 through gate 114 and along ramp 115 to vertical filter magazine 117 where the filters 40 are vertically stacked for introduction from the bottom end of the magazine 117 onto the cigar rolling machine as shown in greater detail in FIGS. 9 and 10. The width of filter magazine 117 may be adjusted to accomodate filters 40 of differing lengths and widths. Hold-down tab 118 is provided at the top of magazine 117 to control the path of the filters 40.

The rate of feed of filters 40 from vibratory hopper 111 along ramp 115 is controlled by the vibration level of the hopper. Ejector block 119, actuated by arm 116, is provided on filter magazine 117 for individually ejecting the filters 40 from ramp 115 into vertical magazine 117 for stacking.

Conventional tobacco filler material 30, which may be treated or contain additives to enhance its burn, taste and aroma, is introduced into filler hopper 120 for passage into scale pan 122 through chute 121. A housing 124 containing one or more magnets is positioned over chute 121 to remove any ferrous or other magnetic metals from the tobacco filler material 30. The tobacco filler material 30 then passes by the vibration of the chute 121 into scale pan 122 which is pivotably mounted on support 127 positioned on base 126. Tension is applied to scale pan 122 by spring 125. Upon the filling of the scale pan 122 with tobacco and upon its activation at a predetermined time by cam shaft 128, scale pan 122 pivots and discharges a pre-determined charge of tobacco filler material into filler chamber 200 positioned below it and adjacent to rolling apron 130 as shown in greater detail in FIG. 9.

Figure 10:
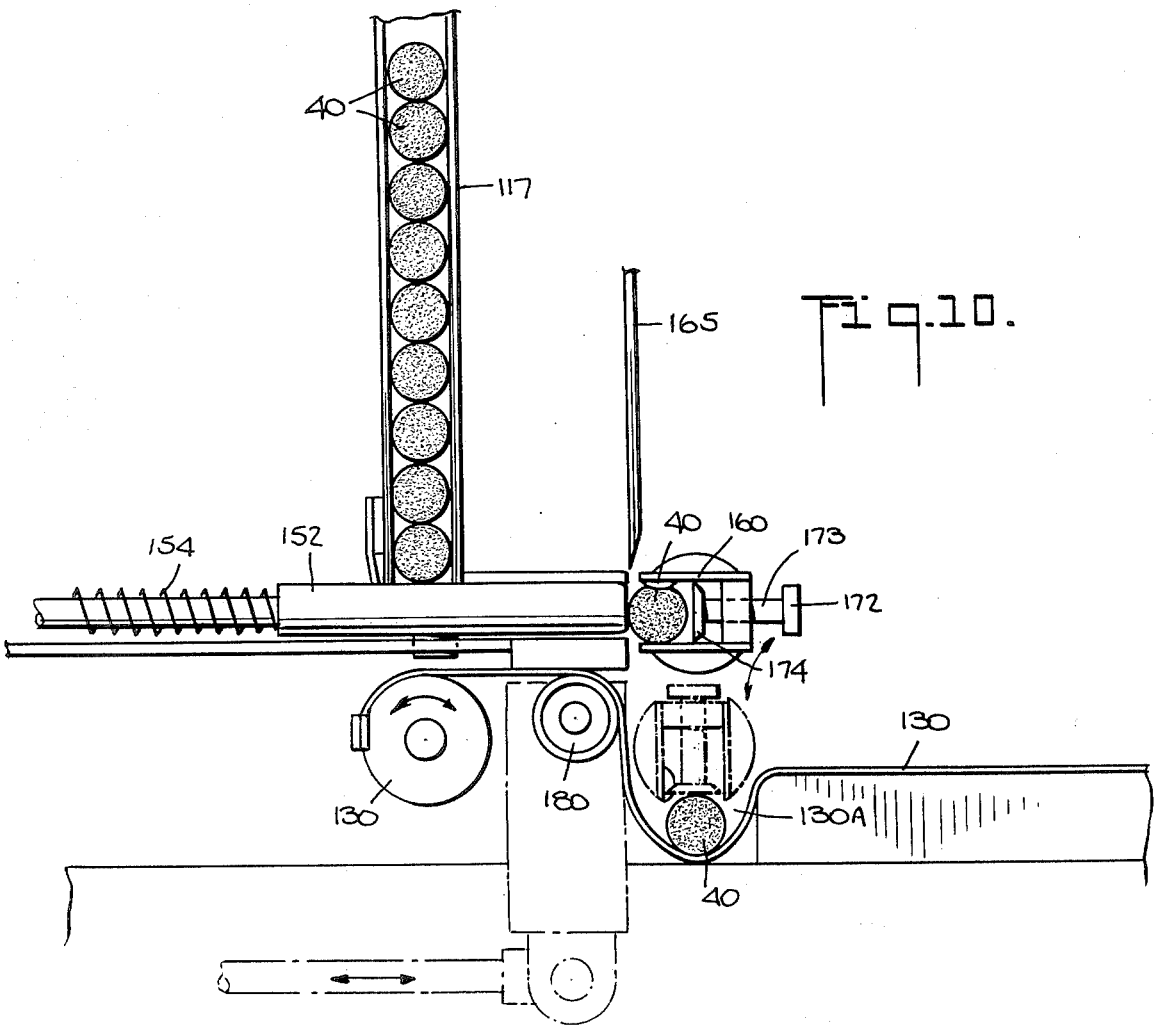
FIG. 10 is a side elevational view of the portion of the cigar rolling machine where the tobacco filler charge and preformed filters are introduced onto the rolling table.
Figure 9:
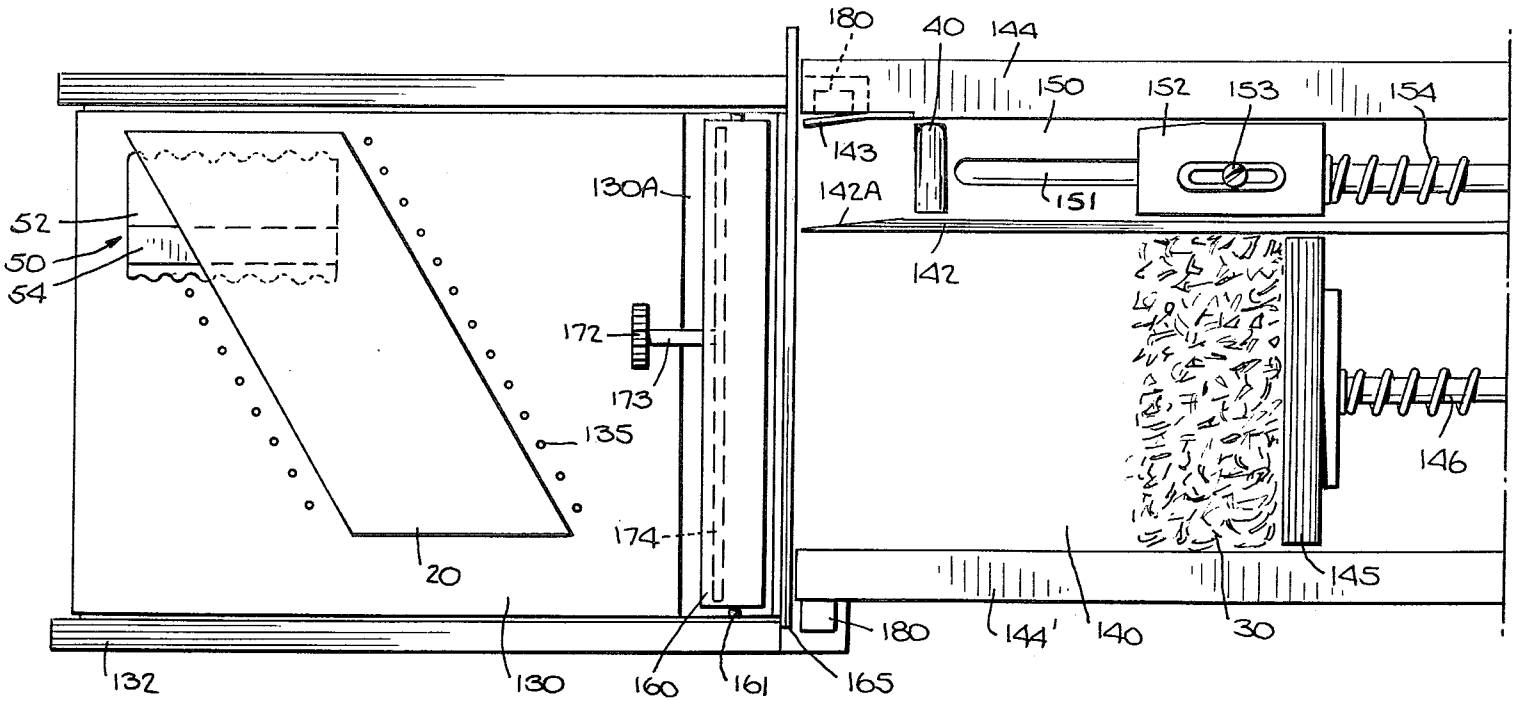
FIG. 9 is a top plan view illustrating the manner in which the tobacco filler charge and preformed filters are introduced onto the rolling table.
Figure 11:
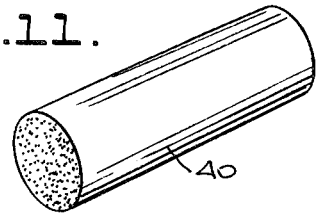
FIG. 11 is a perspective view of the preformed filter prior to crimping.

As seen in FIGS. 9 and 10, the tobacco filler charge 30 discharged from scale pan 122 is deposited in tobacco filler chamber 140 for introduction onto the rolling apron 130 of the rolling table 132. Similarly, the filters 40 stored in vertical magazine 117 are individually deposited from its bottom end in filter chamber 150 for introduction onto the rolling apron 130. Tobacco filler chamber 140 and filter chamber 150 are positioned adjacent to one another at the rear of rolling apron 130 and are defined by side rails 144 and 144' and separated by separator rail 142.

Filler plunger 145 is adapted to compress and drive the tobacco filler charge 30 from the filler chamber 140 toward the rolling apron 130 and onto a pivotably mounted transfer chamber 160 positioned above a depressed well portion 130A of rolling apron 130. Filler plunger 145 is driven by compression spring 146 actuated by a cam controlled lever (not shown) and is adapted, upon the filling of filler chamber 140 with a tobacco filler charge, to drive the filler charge 30 toward and into transfer chamber 160. The size of the filler charge 30 actually deposited in the transfer chamber 160 is established by knife 165.

As the tobacco filler charge 30 is driven by filler plunger 145 into the transfer chamber 160 from filler chamber 140, one of the preferred filters 40 stored vertically in filter magazine 117, is introduced from the bottom end of the magazine 117 into filter chamber 150 where it is driven by filter plunger 152 toward and into transfer chamber 160.

Filter plunger 152 is actuated by compression spring 154 also driven by the same cam controlled lever (not shown) actuating filler plunger 145. Filter plunger 152 travels within filter chamber 150, its length of travel being limited by the length of groove 151 to which it is connected by set screw 153. By this arrangement, filter plunger 152 is adapted to drive each individual filter 40 completely into transfer chamber 160 with the plunger stopping just short of knife 165. Side rail 144 includes a canted guide 143 at its delivery end which is parallel to the canted end 142A of separator rail 142 so that the filters 40 are introduced into transfer chamber 160 between the canted guide 143 and the canted end 142A at a slight angle toward the filler chamber 140 such that the filters 40 are deposited in the transfer chamber 160 tightly against the filler charge 30. By introducing the filters 40 into the transfer chamber 160 in this manner, the filters 40 and filler charge 30 are tightly mated for the rolling operation which follows.

It has also been found that by positioning the filter plunger 152 forward of the filler plunger 145 to introduce the filter 40 into the transfer chamber 160 in advance of the filler charge 30, particularly tight mating between the filter 40 and the filler charge 30 is effected because any loose tobacco of the tobacco filler charge 30 tends to surround the filter 40 and fill any air gaps which might otherwise have existed between these two elements which form the cigar bunch.

The volume and size of transfer chamber 160 may be varied by screw adjustment 172 which is connected by shaft 173 to stop 174 to permit the same cigar machine to be used to roll cigars of different sizes.

Upon the introduction of the filler charge 30 and the preformed filter 40 into transfer chamber 160, transfer chamber 160, as shown in greater detail in FIG. 10, pivots downwardly about pivot 161 and lowers itself as shown by the arrow in FIG. 10 to deposit its contents onto the depressed well portion 130A of rolling apron 130. Upon deposition of its contents onto rolling apron 130, transfer chamber 160 is raised to its original receiving portion to clear rolling pin 180 as the rolling operation commences.

Figure 3:
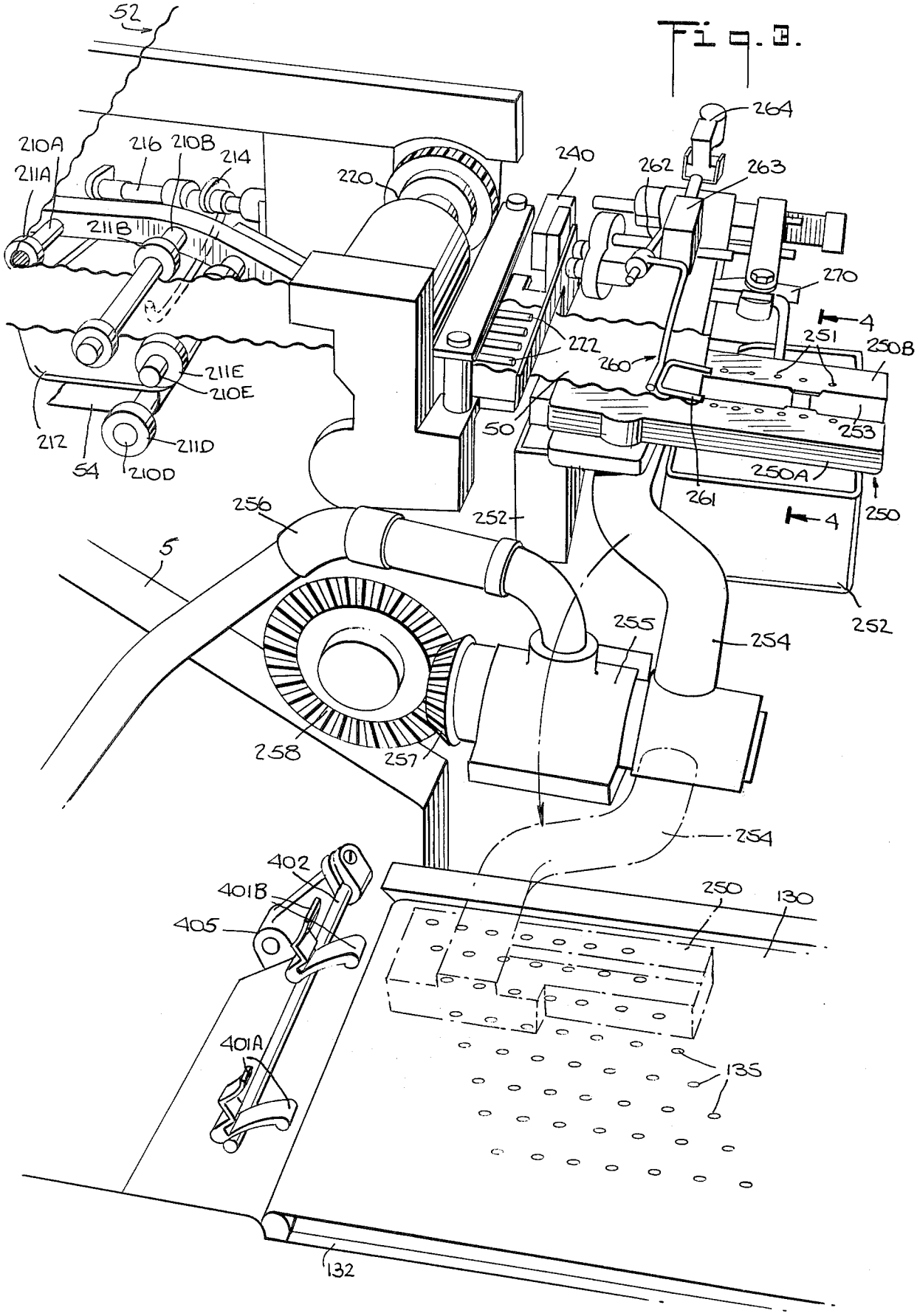
FIG. 3 is a perspective view illustrating the manner in which the reinforcement strip is formed, cut to size, and positioned on the cigar rolling table.
Figure 8:
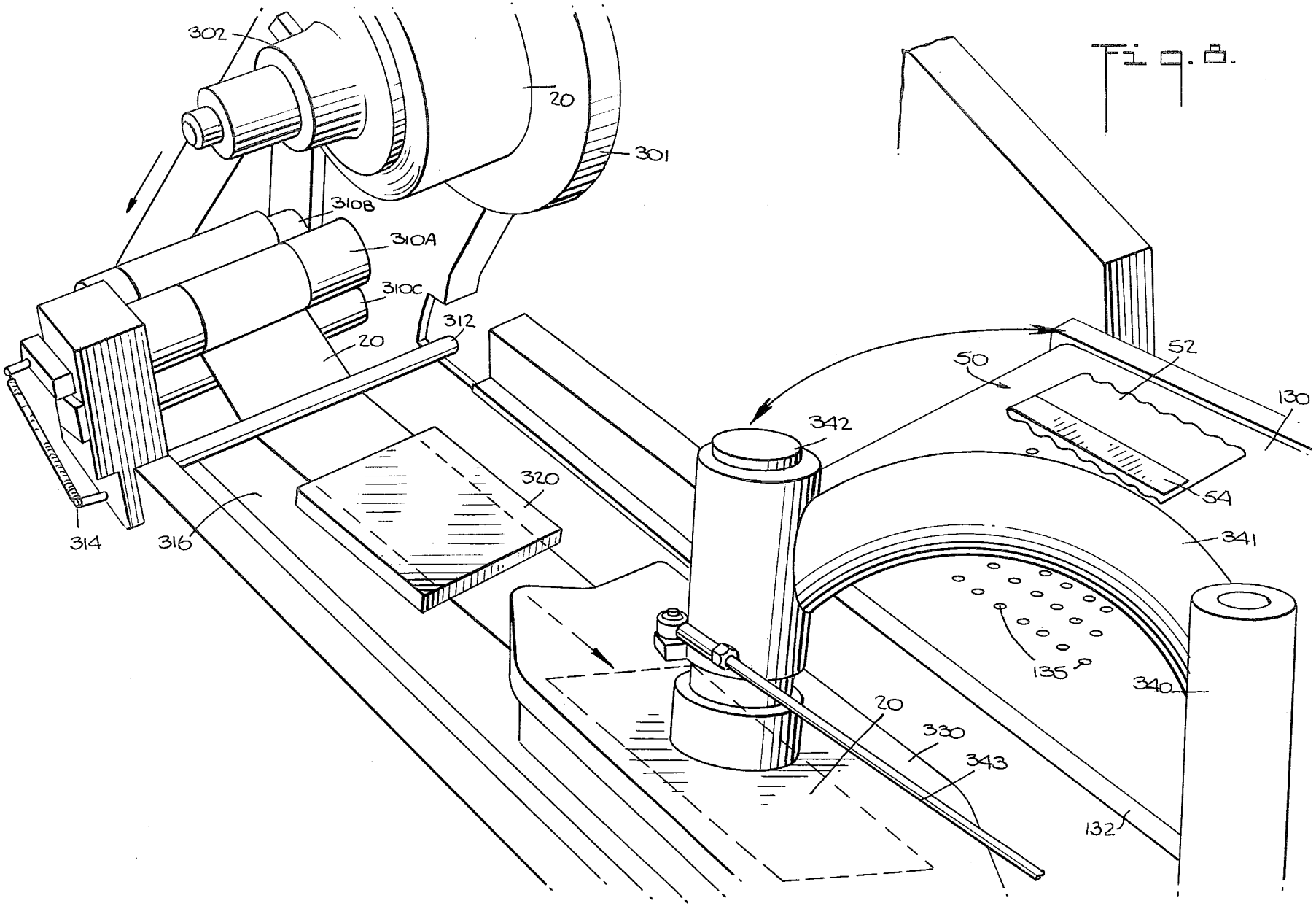
FIG. 8 is a perspective view illustrating the manner in which the cigar binder material is taken off the roll, cut to size and physically positioned on the rolling table.

As the tobacco filler charge 30 and the filter 40 are being deposited onto the well portion 130A, reinforcement strip 50 and a pre-cut sheet of tobacco binder material 20, as shown in FIGS. 1, 3 and 8, are being deposited on a forward portion of rolling apron 130 so that, during the subsequent cigar rolling operation, the binder 20 and reinforcement strip 50 will be rolled about the filter 40 and filler charge 30.

Figure 4:
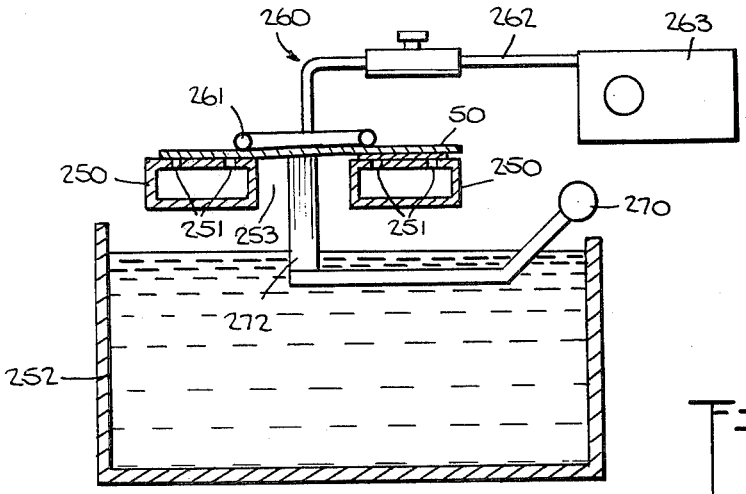
FIG. 4 is a sectional view of the reinforcement strip vacuum transfer platen and reservoir taken along line 4—4 of FIG. 3.
Figures 5, 6, 7:
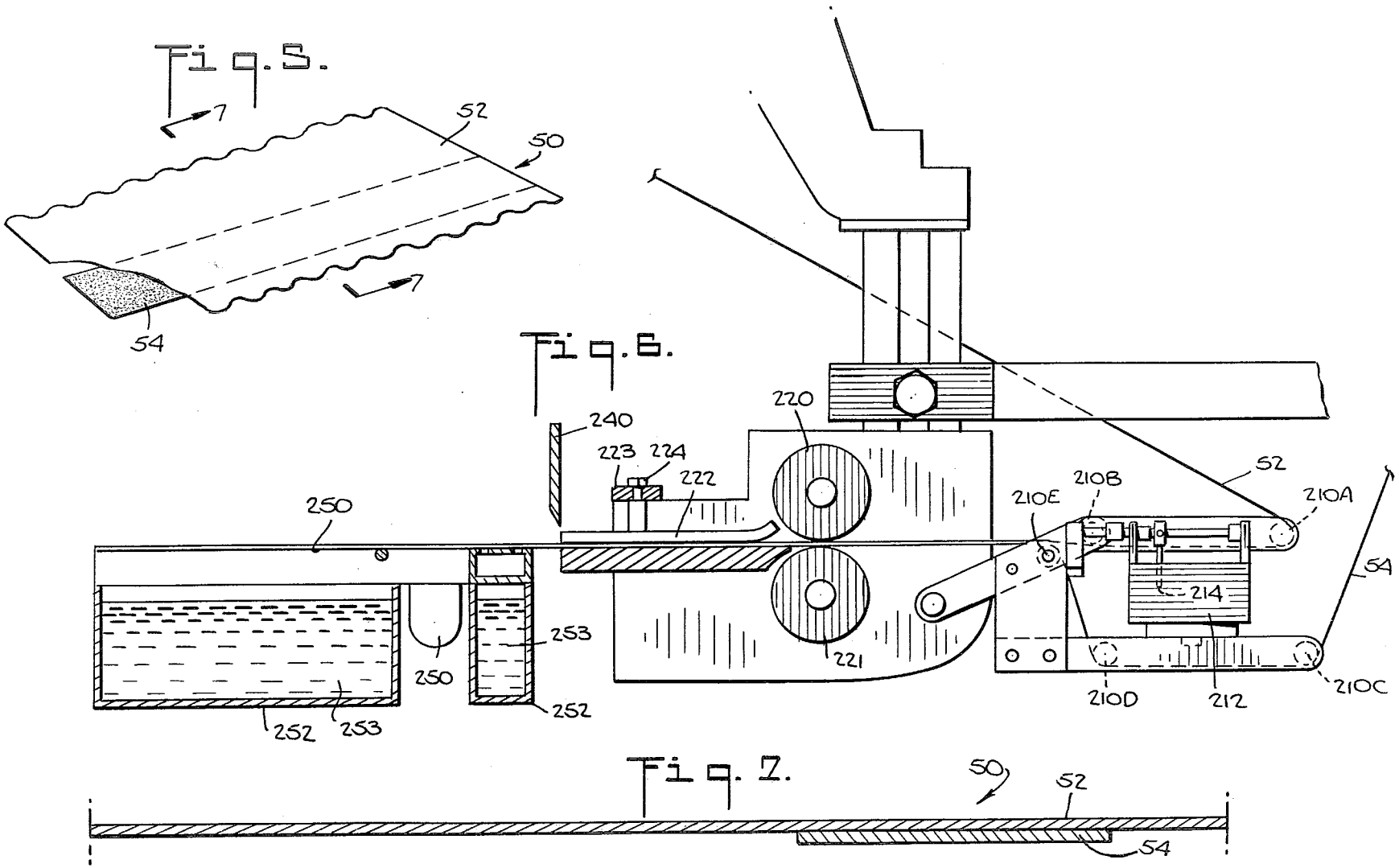
FIG. 5 is an enlarged perspective and partial cutaway view of the reinforcement strip.
FIG. 6 is a side elevational view of the portion of the cigar rolling machine in which the foil and reinforcing tape are joined to form the reinforcement strip.
FIG. 7 is a sectional view of the reinforcement strip taken along line 7—7 of FIG. 5.

The joining together of reinforcing tape 52 and foil 54 to form the reinforcement strip 50 is shown in FIGS. 1, 3, 4 and 6 and the reinforcement strip 50 formed is shown in FIGS. 5 and 7. The placement of the reinforcement strip 50 on rolling apron 130 is shown in greater detail in FIGS. 1, 3 and 6.

Reinforcing tape 52, preferably a paper product having a wet strength, when measured in one quarter inch strips, of at least about 550 grams in the longitudinal direction and at least about 100 grams in the transverse direction, is adapted to, when circumferentially wrapped over the interface between the filter 40 and filler charge 30, prevent separation of these two elements during actual use. Reinforcing tape 52 is most preferably manufactured from virgin paper pulp although it may also be a blend of paper and parchment.

Reinforcing tape 52 as shown in FIGS. 1, 3 and 6 is stored on reel 53 from which it is removed by compression drive rollers 220 and 221 and then passes around take-up rollers 210A and 210B. Take-up rollers 210A and 210B includes guide 211A and 211B to maintain proper alignment of the reinforcing tape 52.

Positioned between and beneath rollers 210A and 210B is adhesive reservoir 212 which contains a suitable adhesive for bonding reinforcing tape 52 to a nonflammable material such as foil 54. A preferred adhesive for effecting such a bond is a food grade polyvinyl acetate emulsion or an emulsion type adhesive product. A particularly preferred polyvinyl acetate emulsion is marketed by Peter Cooper Corporations of Gowanda, New York under the trade designation PVE-1009. Peter Cooper PVE-1009 is a food grade polyvinyl acetate emulsion plasticized with butyl benzol phthallate and includes less than about 1% of a colloidal defoamer and sodium benzoate.

The adhesive in reservoir 212 may be applied to the underside of reinforcing tape 52 in a variety of ways. For example, a sponge (not shown) may be so positioned in reservoir 212 to contact the reinforcing tape 52 as its passes over the reservoir 212 yet be immersed in the adhesive. An alternative means of applying the adhesive to the underside of the reinforcing tape 52 is shown in FIG. 3 wherein a hook-shaped glue daubber or applicator 214 mounted on shaft 216 is provided. Glue applicator 214 is positioned such that it alternately lowers within reservoir 212 to pick up adhesive and then raises to apply the adhesive to the underside of reinforcing tape 52 as the tape 52 passes between rollers 210A and 210B. Glue applicator 214 is adapted to alternatively raise and lower by external cam means (not shown).

As the reinforcing tape 52 is fed off take-up reel 53 and around take-up rollers 210A and 210B, a continuous strip of foil material 54, as shown in FIG. 1, is simultaneously drawn from take-up reel 55 by compression drive rollers 220 and 221, and passes under reservoir 212 and around take-up rollers 210C, D, and E. Take-up rollers 210C, D and E as shown in FIG. 3 include guides 211C, D and E, respectively, to maintain proper alignment of the foil 54.

Nonflammable material 54 may be of virtually any material sufficiently impermeable to the diffusion of air to quench a burning cigar coal and is preferably a metallic foil between about 0.00025 and about 0.00075 inches in thickness. In a most preferred embodiment, foil 54 is aluminum foil having a thickness of about 0.0005 inches. When eventually positioned on the cigar bunch at the point of intersection between the tobacco filler charge 30 and filter 40, foil 54 will serve as a flame extinguisher to extinguish the cigar flame prior to ignition of the filter 40.

Take-up rollers 210C and 210D, as shown in FIGS. 1 and 3, are positioned beneath adhesive reservoir 212 and cause foil 54 to pass under the reservoir 212 and then upwardly and around roller 210E where it is joined in juxtaposition with reinforcing tape 52 to form reinforcement strip 50. Reinforcement strip 50 then passes between compression drive rollers 220 and 221 shown in greater detail in FIG. 6 which exert sufficient pressure to cause the adhesive applied on the underside of reinforcing tape 52 to effect a bond between reinforcing tape 52 and the foil 54. Reinforcement strip 50 then passes under hold-down fingers 222 and onto pivotable vacuum transfer platen 250 which, in its receiving position, is positioned above reservoir 252. Upon advancement of reinforcement strip 50 to a pre-determined point on vacuum transfer platen 250, knife 240 is actuated and cuts a pre-determined length of reinforcement strip 50.

Vacuum transfer platen 250 is generally U-shaped with parallel hollow arms 250A and 250B which define a center slot 253 through which adhesive may be applied to the underside of reinforcement strip 50. A plurality of apertures 251 are provided on both arms 250A and 250B which open to hollowed center portions through which a vacuum is pulled to securely hold the reinforcement strip 50 on the transfer platen 250 during the cutting and adhesive application operations and during transfer to the rolling apron 130.

The particular method of manufacturing a filter cigar where the reinforcement strip 50 is positioned over and bonded to the binder 20 at the interface between the filter 40 and filler charge 30 is illustrated and described in the figures herein. It is understood, of course, that the same apparatus with certain minor modifications which will be described later, may also be employed to circumferentially wrap the reinforcement strip 50 under the binder 20 and directly over the interface between the filter 40 and filler charge 30.

In manufacturing the particular cigar where the reinforcement strip 50 is to be applied over and bonded to the binder 20, a sufficient amount of adhesive to effect the bond between the reinforcement strip 50 and the binder 20 is applied to the underside of reinforcement strip 50 while it is positioned on vacuum platen 250 so that the reinforcement strip 50 will become bonded to the binder 20 when they are joined on the rolling apron 130 prior to rolling. The application of adhesive to the reinforcement strip 50 may be effected in a variety of ways including, for example, by the placement of a sponge (not shown) in the reservoir 252 in such a position that it maintains contact with both the underside of the reinforcement strip 50 through the slot 253 in the vacuum platen 250 and the adhesive.

A preferred method for applying adhesive to the underside of reinforcement strip 50 is shown in FIGS. 3, 4 and 6 wherein an adhesive daubber or applicator 272, pivotably mounted on rod 270, alternately lowers into the reservoir 252 to pick up adhesive and then raises upward and applies the adhesive to the undersurface of the reinforcement strip 50 through the slot 253 in the vacuum plate 250. The alternate raising and lowering of the applicator 272 is effected by external cam control means (not shown).

The adhesive contained in the reservoir 252 may be any suitable adhesive for effecting a bond between the reinforcement strip 50 composed of paper and foil and the tobacco-containing binder 20. Preferred adhesive materials including, for example, a methyl cellulose based adhesive such as the methyl cellulose adhesive marketed by Dow Chemical under the tradename Methocel. Other suitable adhesives for effecting this bond include naturally occurring gums such as gums tragacanth and mixtures of cellulose gums, carboxy methyl cellulose, synthetic gums and protein colloids.

In order to assist in applying adhesive to the underside of reinforcement strip 50, a hold-down arm 260 shown in FIG. 3, is provided to hold the reinforcement strip 50 tightly against the transfer platen 250 during the application of the adhesive from reservoir 252. Hold-down arm 260 includes a fork-shaped portion 261 which contacts the reinforcement strip 50 and which is mounted on shaft 262 and secured to block 263. Control means 264 connected to block 263 are provided which cause hold-down arm 260 to pivot sufficiently upwardly and outwardly to avoid contact with the platen 250 when the plated 250 pivots from its receiving position to deposit the reinforcement strip 50 on rolling apron 130.

Vacuum transfer platen 250 as shown in FIG. 3, is mounted on transfer arm 254 which, in turn, is pivotably mounted on gear drive 255 including gear 257. Gear 257 engages complimentary gear 258 connected to external means (not shown) for controlling and effecting movement of the transfer platen 250 from its receiving position to its delivery position.

As previously stated, the reinforcement strip 50 is maintained in proper position on transfer platen 250 by the pulling of a vacuum through aperatures 251 in transfer platen 250 from an external vacuum source (not shown) through vacuum tube 256 and 254. Gear 258 is activated at a pre-determined time, i.e., after reinforcement strip 50 has been cut to size and the adhesive has been applied to its underside by external means which causes transfer platen 250 to pivot with the pre-cut reinforcement strip 50 held in place by the vacuum and swing outwardly and downwardly toward rolling apron 130 as shown by the arrow in FIG. 3. Upon completion of the pivot of transfer platen 250 to its delivery position above the rolling apron 130, the vacuum is shut off and the strip 50 deposited on the apron 130 as shown in FIG. 8 with the foil strip 54 and adhesive containing side upwardly facing.

Upon placement of the reinforcement strip 50 on rolling apron 130, a pre-cut sheet of cigar binder material 20 is then placed over the reinforcement strip 50 by a conventional binder transfer unit 340 shown in greater detail in FIG. 8. The cigar binder material 20 may be either natural, i.e. a leaf of broad leaf tobacco or manufactured binder material, approximately two-thirds of which is tobacco, the balance being conventional filler materials.

As shown in FIG. 8, rolled binder material 20 is taken off take-up reel 301 by drive rollers 320 positioned on table 316. Binder material 20 which is retained in place on reel 301 by hub 302, passes around take-up rollers 310A, 310B and 310C, the proper tension of which is maintained by spring 314 and under bar 312. The binder material 20 is then fed under vacuum binder transfer platen 330 where it is cut into pre-determined lengths and transferred to the rolling apron 130 over and at an angle relative to the reinforcement strip 50, as shown in FIG. 1. The diagonal placement of binder 20 relative to the reinforcement strip 50 results in the binder 20, during the subsequent rolling operation, becoming spirally wound about the filter 40 and filler charge 30 with the reinforcement strip circumferentially wound over the interface between the filter 40 and filler charge 30.

The outward and downward rotation of the binder transfer platen 330 from table 316 to rolling apron 130 is effected by the pivoting of binder transfer unit 340 powered by external means (not shown) with transfer arm 341 moving in the direction of the arrow shown in FIG. 8. The strip of binder material 20 is diagonally positioned on the rolling apron 130 relative to the reinforcement strip 50 by the pivoting of the transfer platen 330 about pivot 342. The extent of the pivot of platen 330 is controlled by guide rod 343 which permits placement of the binder 20 at virtually any pre-determined angle relative to the reinforcement strip 50. The pre-cut length of binder material 20 is retained on the vacuum transfer platen 330 during transfer by a vacuum drawn from an external source (not shown) through transfer arm 340. Upon proper positioning of the binder transfer platen 330 over the reinforcing strip 50 on the rolling apron 130, the vacuum drawn through transfer arm 340 is cut off and the binder material 20 deposited over the reinforcement strip 50. The adhesive applied to the upwardly facing surface of reinforcement strip 50 effects a bond between the reinforcement strip 50 and the binder material 20. After the deposit of the binder strip 20 on the rolling apron 130, the rolling operation shown in FIGS. 12–15 is ready to commence.

Figure 23:
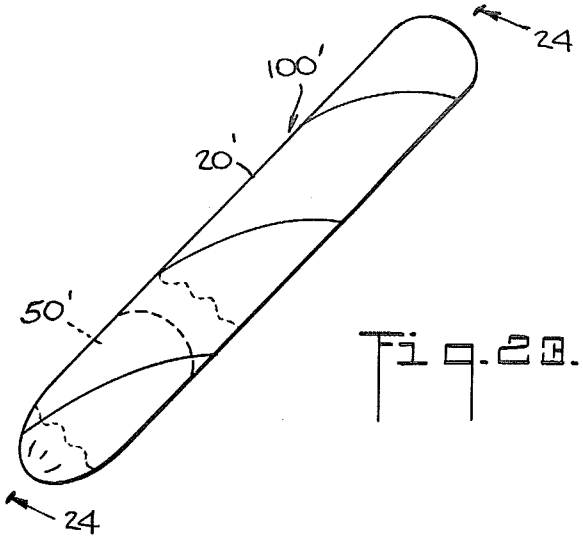
FIG. 23 is a perspective view illustrating the crimped and located but unwrapped cigar bunch manufactured in accordance with an alternative embodiment of the method and apparatus of the present invention wherein the reinforcement strip is positioned under the binder.
Figure 24:
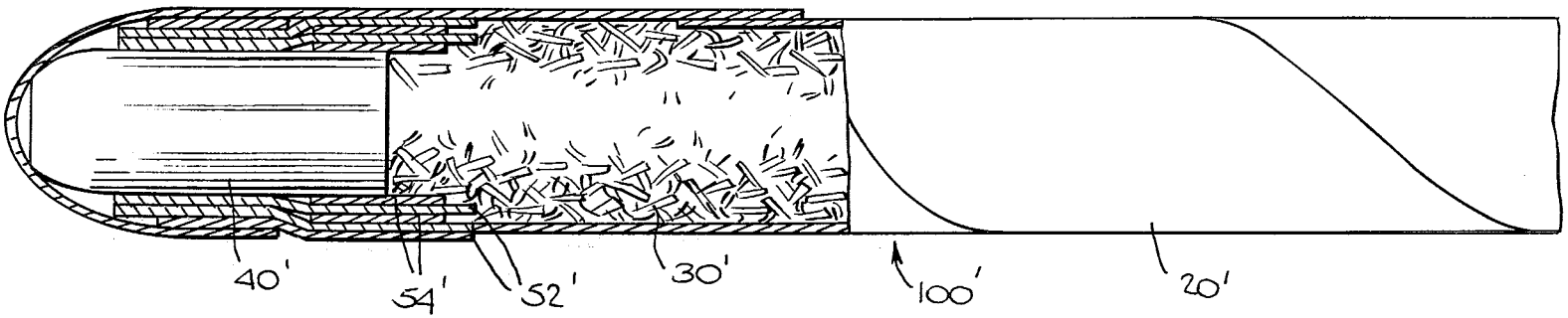
FIG. 24 is an enlarged sectional view taken along line 24—24 of FIG. 23.

In an alternative embodiment (not shown), the present apparatus may be used to manufacture the filter cigar shown in FIGS. 23 and 24 wherein the reinforcement strip 50' is placed directly over the interface between the filter 40' and filler charge 30' and under the binder 20'. The same operations previously described, with certain minor changes, are followed. The preferred filters 40' and filler charges 30' are deposited on the rolling apron 130 in the manner described and the reinforcement strip 50' including strips of reinforcing tape 52' and 54' is likewise formed. In this embodiment, however, after the reinforcement strip 50' is cut to its pre-determined length, no adhesive is applied to the underside of the reinforcement strip 50' while positioned on the vacuum transfer platen 250. As the reinforcement strip 50' has to be wrapped under the binder 20', the pre-cut length of binder material 20' is first deposited on the rolling apron 130 and adhesive applied to its upwardly facing side prior to deposit of the reinforcement strip 50' which is then positioned over and bonded to the binder 20'. Conventional means of applying the previously described adhesive to the binder 20' while on the rolling apron 130 may be used including, for example, by the use of a cam actuated daubber. The cigar is then rolled and crimped by the rolling and crimping operations described in FIGS. 12–20.

Figure 15:
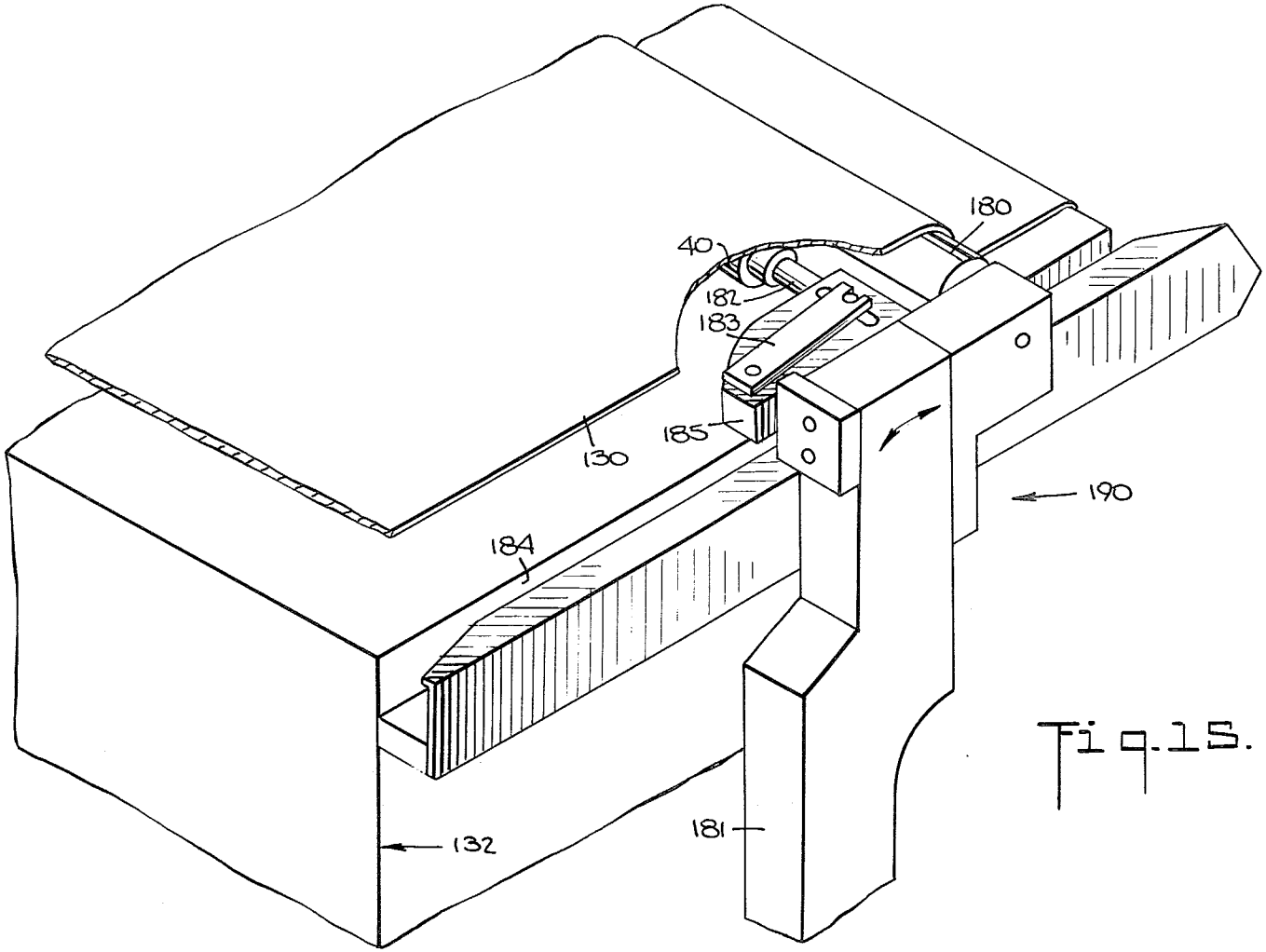
FIG. 15 is a perspective view illustrating the tamper apparatus of the present invention.

The actual rolling operation, as shown in FIGS. 12–15, with the exception of providing the tamper means shown in FIG. 15 for retaining the filter 40 tightly against the filler charge 30 during rolling, is an otherwise conventional rolling procedure performed on an otherwise conventional cigar rolling table. Rolling apron 130, as shown in FIG. 1, includes a plurality of aperatures 135 having access to a hollow central portion of rolling table 132 connected to suitable sources of suction (not shown). The suction holds the pre-cut sheet of binder material 20 and reinforcement strip 50 securely in place during the rolling operation.

Figures 12, 13, 14, 21, 22:
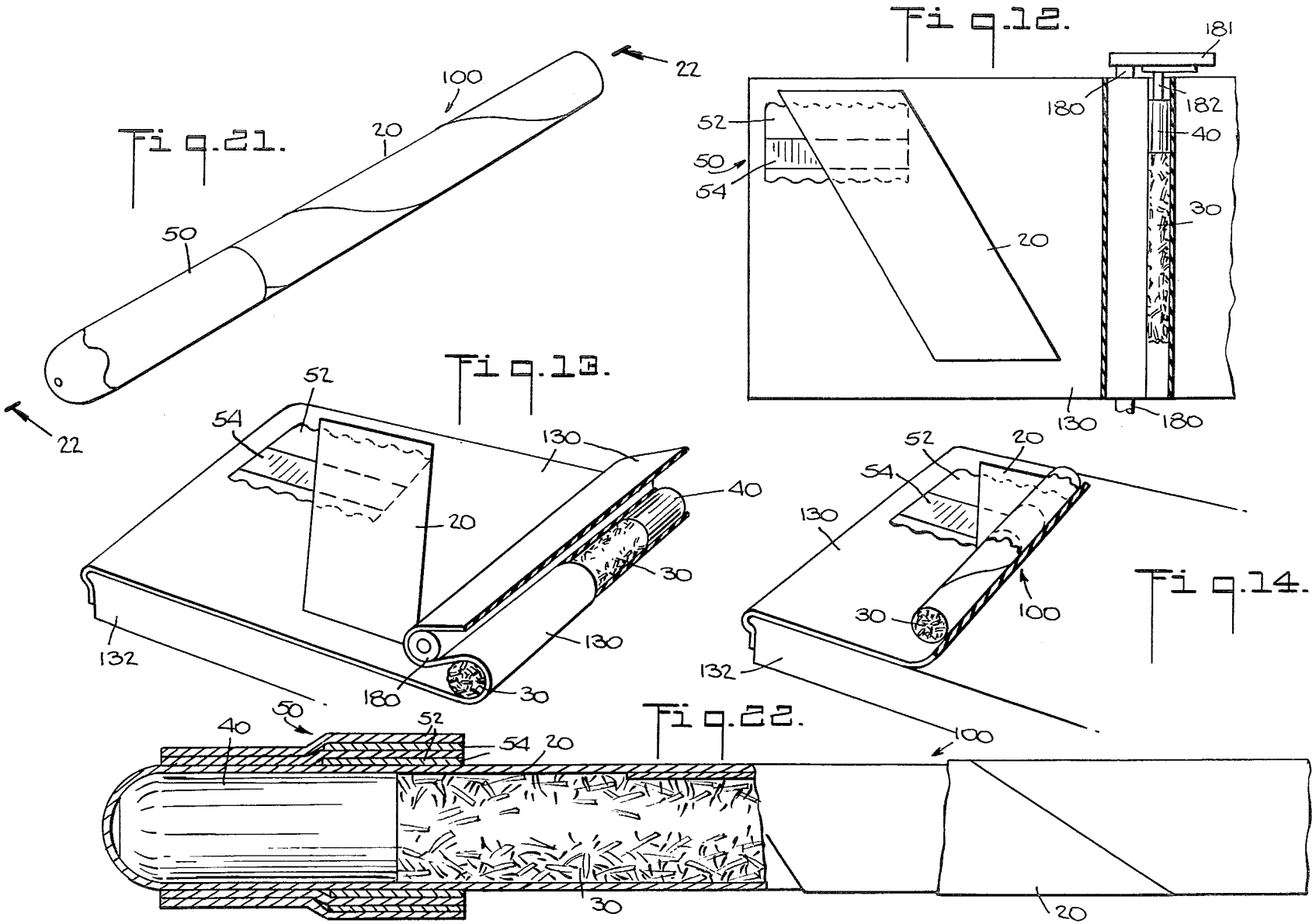
FIG. 12 is a top plan view of the rolling apron of the rolling table illustrating the manner in which the preformed filter and tobacco filler charge are rolled within the binder and reinforcement strip to form the cigar bunch.
FIGS. 13 and 14 are perspective views illustrating, in sequential order, the manner in which the preformed filter and filler charge are rolled within the binder and reinforcement strip to form the cigar bunch.
FIG. 21 is a perspective view illustrating the crimped and located but unwrapped cigar bunch manufactured in accordance with the method and apparatus of the present invention wherein the reinforcement strip is positioned over the binder.
FIG. 22 is an enlarged sectional view taken along line 22—22 of FIG. 21.

Upon deposition of the filter 40 and filler charge 30 in the well portion 130A of rolling apron 130, the rolling operation shown in FIGS. 12–14 commences by the forward motion of rolling pin 180 toward the forward portion of the rolling apron 130 where the reinforcement strip 50 and binder 20 have been deposited.

As shown in FIG. 13, the advance of rolling pin 180 causes the filter 40 and the filler charge 30 to be rolled within the loop of the apron 130 and the continued advance of the rolling pin 180, as shown in FIG. 14, causes the filler charge 30 to be coiled in helical convolutions and tightly mated with the plug filter positioned at its head end. The further advance of the rolling pin 180 causes the binder material 20 placed diagonally on the rolling apron 130 to be spirally wrapped about the filler charge 30 and filter 40 and the longitudinally positioned reinforcement strip 50 to be circumferentially wrapped over the binder 20 at the interface between the filler charge 30 and the filter 40.

As shown in greater detail in FIG. 15, tamping means 190 are provided along track 184 which extends virtually along the entire longitudinal extent of rolling apron 130 at the edge of rolling table 132. Tamping means 190, which provides constant pressure against the filter 40 during the rolling operation to insure a tight mating between the filter 40 and filler charge 30, includes a plunger 182 which maintains constant contact with the filter 40 during the rolling operation. Plunger 182 is mounted on a filter tamper bracket 185 secured to the rear portion of the rolling operating arm 181 to which is also secured, at its forward portion, rolling pin 180. A lever 183 is provided on filter tamper bracket 185 for adjusting the tension of plunger 182. In this manner, as rolling pin 180 completes the cigar bunch rolling operation, plunger 182 maintains constant pressure against the filter 40 to insure a tight mating between the filter 40 and the tobacco filler charge 30.

Upon completion of the rolling operation, the rolled but unlocated and uncrimped cigar bunch 100 includes a preformed filter 40 and filler charge 30 encased in a spirally wrapped binder 20 and further includes a reinforcement strip 50 circumferentially wrapped over the interface between the filler charge 30 and the filter 40. As previously explained, the reinforcement strip 50 may be positioned either under or over the binder 20.

Figure 17:
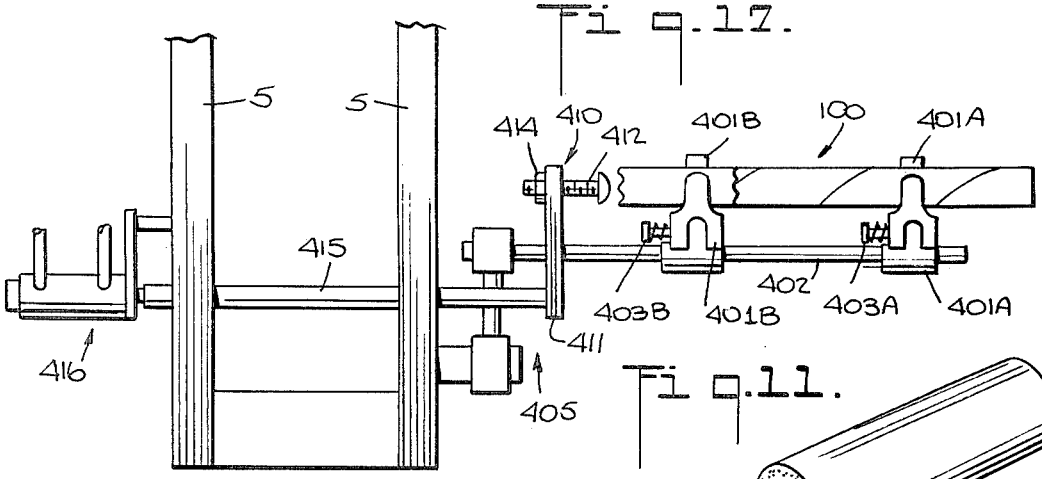
FIG. 17 is an end view illustrating the locator apparatus.
Figure 16:
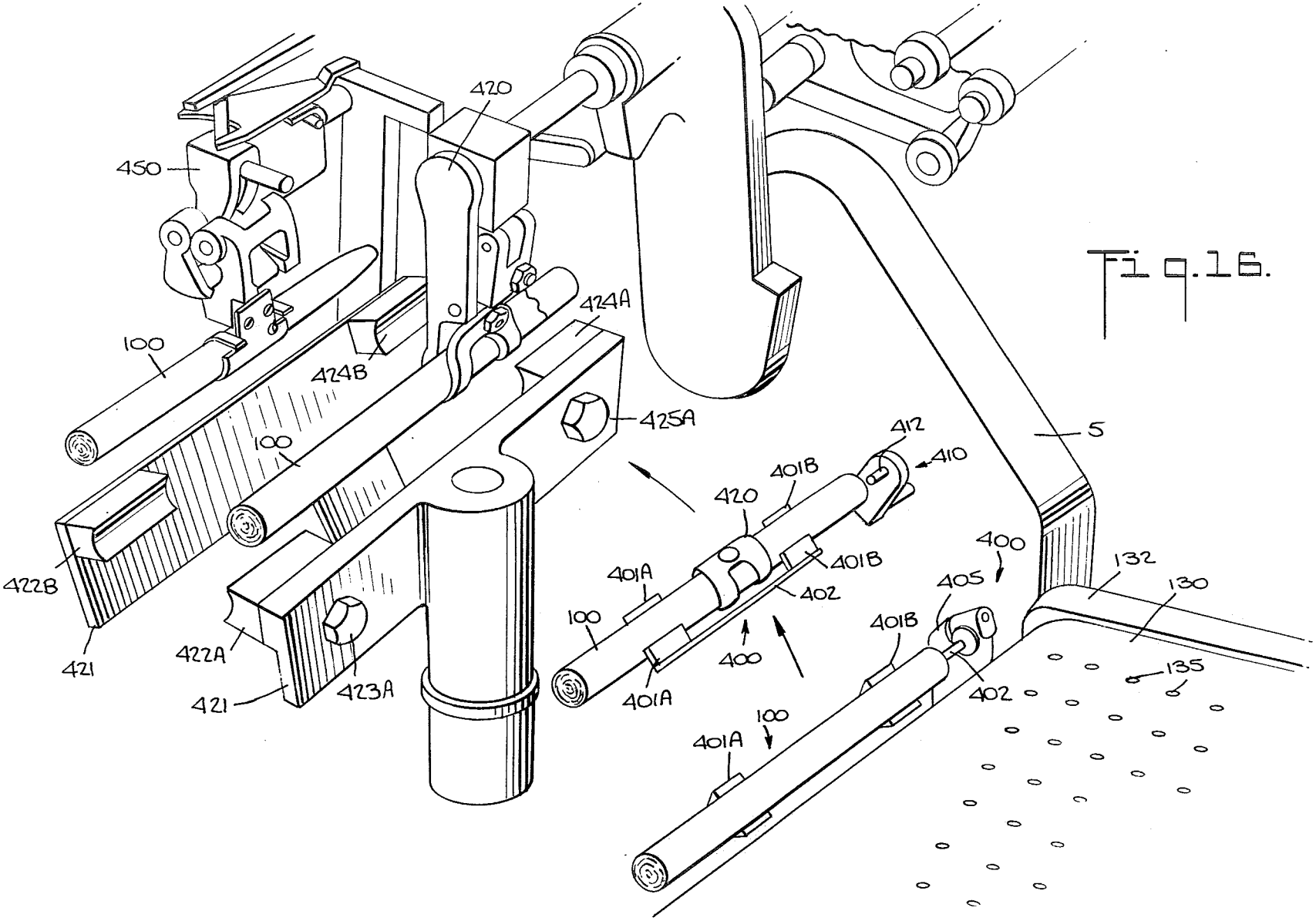
FIG. 16 is a perspective view illustrating the manner in which the rolled cigar bunch is located and crimped.

Rolled bunch 100 is then physically removed from the rolling apron 130 of rolling table 132, as shown in FIGS. 16 and 17, by locator transfer assembly 400. Locator transfer assembly 400 includes a pair of gripping fingers 401A and 401B mounted on shaft 402. As shown particularly in FIG. 17, the jaw width of fingers 401A and 401B may be adjusted by adjusting screws 403A and 403B to permit its use with cigar bunches of varying thickness. Shaft 402 is secured to locator transfer drive assembly 405 which is adapted, upon gripping of the cigar bunch 100, to rotate the locator transfer assembly 400 as shown by the arrow in FIG. 16 and position the bunch 100 for location of the filter 40 relative to the tobacco filler charge 30 by locator assembly 410.

Locator assembly 410, as shown in FIGS. 16–19, includes a locating element 412 threadably secured to plate 411 by nut 414 and which is affixed to a double acting air cylinder 416 by shaft 415 extending through the frames of the cigar rolling machine.

Figure 18:
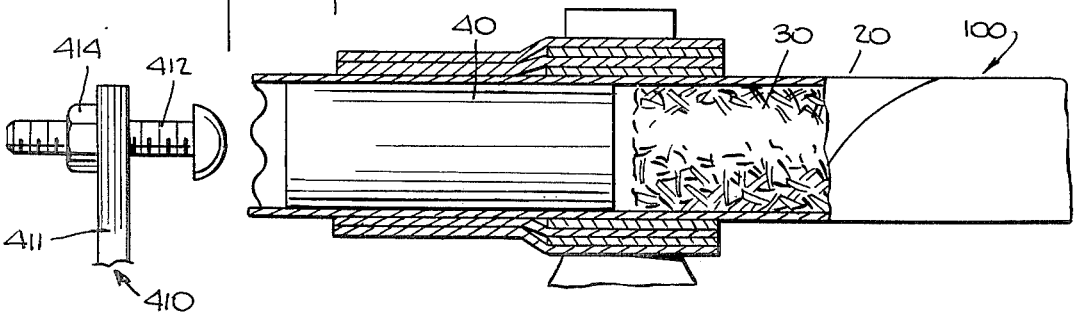
FIGS. 18 and 19 are enlarged sectional views illustrating the manner in which the locating apparatus of the present invention compresses the preformed filter against the filler charge after rolling and prior to crimping.
Figure 19:
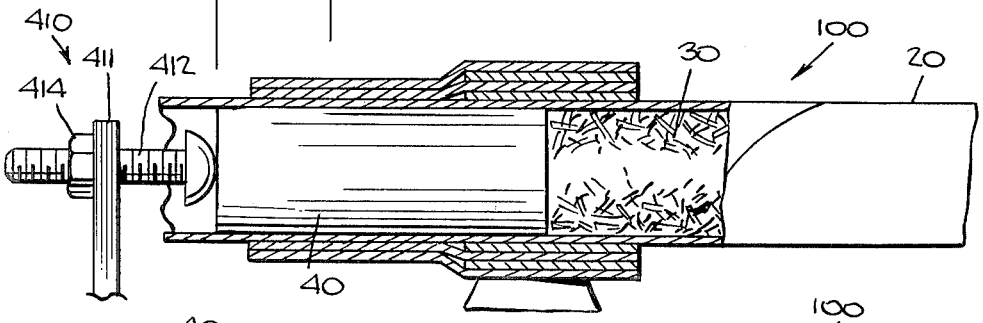
Figure 20:
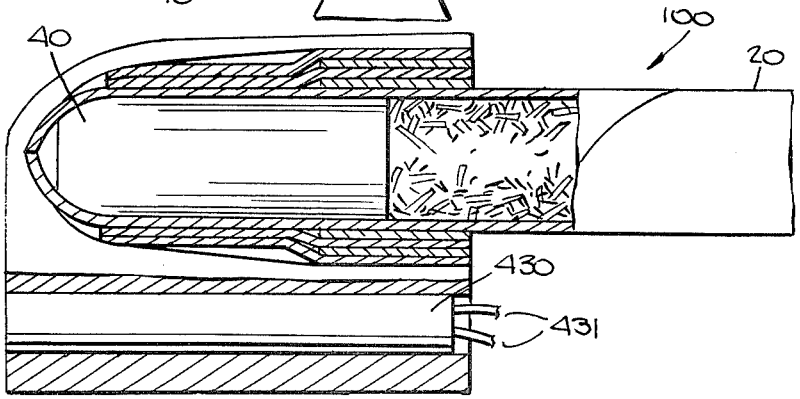
FIG. 20 is an enlarged sectional view illustrating the manner in which the head end of the located cigar bunch is crimped.

As shown sequentially in FIGS. 18 and 19, upon positioning of the rolled cigar bunch 100 relative to the locator assembly 410, air cylinder 416 becomes activated by external means (not shown) and causes locating element 412 to be inserted in the cigar bunch 100 against the filter 40 to compress the filter 40 against the filler charge 30. The locating element 412 is then retracted and returned to its original position. The cigar bunch 100, as shown in FIG. 16, is picked up from fingers 401A and 401B by crimper transport 420 for transporting to crimper 421 wherein it is positioned with its filler end between end jaws 422A and 422B and with its head end between head jaws 424A and 424B. End jaws 422A and 422B are retained in place by bolts 423A and 423B (not shown), and head jaws 424A and 424B are retained in place by bolts 425A and 425B (not shown). End jaws 422A and 422B are conventional cigar crimper jaws adapted to trim off any excess filler material while head jaws 424A and 424B, as shown in FIG. 20, include heating elements 430 connected by leads 431 to external heating sources (not shown). Heating elements 430 are conventional heating elements and are intended to heat the head end of the bunch 100 during the crimping operation to a temperature of approximately 250° F. to shape the end of the preformed filter 40 to provide a standard large cigar appearance.

The crimped but unwrapped bunch 100 and 100' shown in FIGS. 21–22 and FIGS. 22–23 are described in greater detail in concurrently filed U.S. patent application Ser. No. 009,612, entitled "Filter Cigar" filed on Feb. 5, 1979, in the names of William F. Cartwright, Alan Cornell, D. Bernard Higgins and Robert P. Mikkelson.

Upon completion of the crimping operation, a conventional wrapper transport 450, as shown in FIG. 16, removes the crimped and located bunch 100 from the crimper 421 for transportion to a subsequent wrapping operation (not shown) wherein a cigar wrapper is conventionally wrapped about the bunch. Conventional cigar wrappers which may be used include natural tobacco leaf wrappers or manufactured wrappers such as, for example, manufactured wrappers which have been decorated to simulate an external tobacco leaf by the embossing of a vein-like portion thereon.

Having thus described the invention with particular reference to the preferred forms thereof, it will be obvious that various changes and modifications may be made thereon without departing from the spirit and scope of the invention as defined by the appended claims.

What is claimed is:

1. A method for manufacturing a cigar bunch having a preformed cigar filter and a tobacco filler charge wrapped in a sheet of cigar binder material and having a reinforcement strip wrapped over the interface between said filter and said filler charge, said method comprising the steps of:

introducing onto a cigar bunch rolling table a preformed cylindrically shaped cigar filter, a tobacco filler charge, a sheet of cigar binder material and a reinforcement strip; and rolling said binder material and reinforcement strip into said rolled bunch about said filter and filler charge while compressing said Filter against said filler charge by inserting a locating element to form a cigar bunch, said binder being spirally wrapped about said filter and filler charge and said reinforcement strip being circumferentially wrapped over the interface between the filter and the filler charge.

2. The method of claim 1 further including the step of forming said reinforcement strip prior to its introduction onto the rolling table by bonding a strip of a nonflammable material to a high wet strength reinforcing tape and cutting a predetermined length of said reinforcement strip.

3. The method of claim 1 further including the step of bonding together said binder and said reinforcement strip after introduction onto said rolling table and prior to the rolling operation.

4. The method of claim 1 further including the step of maintaining constant pressure against said filter to provide a tight mating between the filter and the filler charge.

5. The method of claim 1 further including the step of crimping the head end of said cigar bunch with heated crimper means.

6. The method of claim 1 further including the step of wrapping said rolled bunch with a sheet of cigar wrapper material to form a filter cigar.

7. The method of claim 1 wherein said filter is introduced onto said table in advance of and at an angle relative to said filler charge.

8. A method for manufacturing a cigar bunch having a preformed cigar filter and a tobacco filler charge spirally wrapped in a sheet of cigar binder material and having a reinforcement strip circumferentially wrapped over the interface between said filter and said filler charge, said method comprising the steps of:

forming a reinforcement strip by bonding a strip of metallic foil to a strip of high wet strength reinforcing tape and cutting a pre-determined length of said strip;

cutting a pre-determined length of cigar binder material;

introducing onto a cigar bunch rolling table a preformed cigar filter and a tobacco filler charge;

introducing onto said rolling apron said reinforcement strip and said length of binder material and bonding said reinforcement strip to said binder material, said binder material being positioned on said table at a diagonal to said reinforcement strip;

rolling said filter, filler charge, binder material and reinforcement strip to form said cigar bunch while maintaining constant pressure against said filter to insure a tight mating between the filter and said filler charge; and locating said filter relative to said filler charge after rolling by inserting a locating element into the rolled bunch against the filter to compress the filter against the filler charge.

9. The method of claim 8 wherein said filter is introduced onto said table in advance of and at an angle relative to said filler charge.

10. The method of claim 8 wherein said filter is introduced onto said table in advance of and at an angle relative to said filler charge.

11. The method of claim 8 further including the steps of crimping the head end of said located cigar bunch with heated crimper means and wrapping said bunch with a sheet of cigar wrapper material to form a filter cigar.

12. A method for manufacturing a cigar bunch having a preformed cigar filter and a tobacco filler charge spirally wrapped in a sheet of cigar binder material and having a reinforcement strip circumferentially wrapped over the interface between said filter and said filler charge, said method comprising the steps of:

forming a reinforcement strip by bonding a strip of metallic foil to a strip of high wet strength reinforcing tape and cutting a pre-determined length of said reinforcement strip;

cutting a pre-determined length of cigar binder material;

introducing onto a cigar bunch rolling table a preformed cigar filter and a tobacco filler charge, said filter being introduced onto said table in advance of and at an angle relative to said filler charge;

introducing onto said rolling apron said reinforcement strip and said strips of binder material and bonding said reinforcement strip to said binder material, said binder material being positioned on said rolling table at a diagonal to said reinforcement strip;

rolling said filter, filler charge, binder material and reinforcement strip to form said cigar bunch while maintaining constant pressure against said filter to insure a tight mating between said filter and said filler charge;

locating said filter relative to said filler charge after rolling by inserting a locating element into the rolled bunch against the filter to compress the filter against said filler charge; and crimping the head end of said cigar bunch with heated crimper means.

13. The method of claim 12 further including the step of wrapping said crimped bunch with a sheet of cigar wrapper material to form a filter cigar.

14. An improved cigar rolling machine for manufacturing filter cigars wherein a preformed filter and a tobacco filler charge are rolled on a cigar rolling table in a sheet of cigar binder material to form a filter cigar bunch, wherein the improvement comprises the inclusion of:

means for forming a reinforcement strip;

means for introducing said reinforcement strip onto said rolling table relative to a sheet of binder material also deposited on said table such that said strip will be circumferentially wrapped about the bunch and over the interface between the filter and filler charge upon completion of the rolling operation, and means for maintaining constant pressure against said filter during the rolling operation.

15. The rolling machine of claim 11 wherein said reinforcement strip includes a strip of reinforcing tape bonded to a strip of nonflammable material.

16. The rolling machine of claim 14 further including locating means for compressing said filter against said filler charge after completion of the rolling operation.

17. The rolling machine of claim 14 further including heated head end crimper means for forming the head end of the bunch.

18. An improved cigar rolling machine for manufacturing filter cigars wherein a preformed filter and a tobacco filler charge are rolled on a cigar rolling table in a sheet of cigar binder material to form a filter cigar bunch, wherein the improvement comprises the inclusion of:

means for forming a reinforcement strip; means for introducing said reinforcement strip onto said rolling table relative to said sheet of binder material also deposited on the table such that said strip will be circumferentially wrapped about the bunch and over the interface between the filter and filler charge upon completion of the rolling operation;

tamping means for maintaining constant pressure against said filter during the rolling operation;

locating means for compressing the filter against said filler charge at the conclusion of the rolling operation; and heated head end crimper means for forming the filter head end of the cigar bunch.

19. An improved cigar rolling machine for manufacturing filter cigars wherein a preformed filter and a tobacco filler charge are rolled on a cigar rolling table in a sheet of cigar binder material to form a filter cigar bunch, wherein the improvement comprises the inclusion of:

reinforcement strip forming means for bonding together, in juxtaposition, strips of reinforcing tape and foil to form a reinforcement strip;

reinforcement strip cutting means for cutting said reinforcement strip into pre-determined lengths; and reinforcement strip transport means for depositing said cut lengths onto said rolling table positioned relative to a sheet of binder material also deposited on the table such that, upon completion of the subsequent rolling operation, the reinforcement strip will be circumferentially wrapped over the interface between the filter and filler charge.

20. The machine of claim 19 further including means for simultaneously introducing onto said rolling apron a preformed filter and a tobacco filler charge, said means including:

a vertical filter storage magazine positioned adjacent to a filler scale pan for introducing into adjacent storage chambers a filter and a filler charge; and means for depositing said filter and filler charge into a transfer chamber for simultaneous introduction onto said rolling table such that said filter is deposited into said transfer chamber in advance of said filler charge and at an angle toward said charge.

21. The machine of claim 19 further including binder forming means for cutting pre-determined lengths of cigar binder material and depositing said lengths onto said rolling table.

22. The machine of claim 19 further including means for effecting a bond between said reinforcement strip and said binder.

23. The machine of claim 19 further including roller means for rolling said filter and said filler charge in said binder and reinforcement strip, said roller means including tamping means for maintaining constant pressure against said filter during the rolling operation.

24. The machine of claim 23 wherein said tamping means comprises a plunger mounted on roller means.

25. The machine of claim 19 further including locating means for locating the filter relative to the filler charge after rolling, said locator means including a locating element adapted to be inserted into the rolled cigar bunch and compress the filter against the filler charge.

26. The machine of claim 19 further including heated crimper means for forming the head end of said rolled and located cigar bunch, said means including a heating element incorporated in a crimper jaw.

27. An improved cigar rolling machine for manufacturing filter cigars wherein a preformed filter and tobacco filler charge are rolled on a cigar rolling table within a sheet of cigar binder material to form a filter cigar bunch wherein the improvement comprises the inclusion of:

a vertical filter storage magazine positioned adjacent to a filter scale pan, said magazine and scale pan adapted to introduce into an adjacent storage chamber a filter and a tobacco filler charge;

means for depositing said filter and said filler charge into a transfer chamber for simultaneous introduction onto said rolling table, said means for depositing being adapted to deposit said filter into said transfer chamber in advance of said filler charge and at an angle toward said charge;

reinforcement strip forming means, said forming means adapted to bond together, in juxtaposition, strips of reinforcing tape and foil to form a reinforcement strip and to cut said reinforcement strip into pre-determined lengths;

reinforcement strip transport means, said reinforcement strip transport means adapted to deposit said cut lengths of reinforcement strip on said rolling table;

binder forming means for cutting pre-determined lengths of binder material and depositing said lengths onto said roller table; said length of binder material and said reinforcement strip being so positioned on the rolling table that, upon completion of the subsequent rolling operation, the reinforcement strip will be circumferentially wrapped over the interface between the filter and filler charge;

means for effecting a bond between said reinforcement strip and said binder;

roller means for rolling said filter and said filler charge in said binder material and reinforcement strip to produce said filter cigar bunch, said roller means including tamping means to maintain constant pressure against said filter during the rolling operation;

locator means for locating the filter and filler charge after rolling, said locator means including a locating element adapted to be inserted into said rolled bunch to compress said filter against said filler charge; and heated crimper means for forming the head end of said rolled and located cigar bunch, said crimper means including a heating element incorporated in a crimper jaw.

* * * * *